US006298697B1

(12) United States Patent
Ramsauer

(10) Patent No.: US 6,298,697 B1
(45) Date of Patent: Oct. 9, 2001

(54) PIVOTING LEVER CLOSURE FOR DOOR OR SIDEWALL OF AN ELECTRICAL CONTROL CABINET OR A MACHINE CASING

(76) Inventor: Dieter Ramsauer, Am Neuhauskothen 20, D-42555 Velbert (DE)

( * ) Notice: Subject to any disclaimer, the term of this patent is extended or adjusted under 35 U.S.C. 154(b) by 0 days.

(21) Appl. No.: 09/367,335

(22) PCT Filed: Nov. 18, 1998

(86) PCT No.: PCT/EP98/07390

§ 371 Date: Oct. 25, 1999

§ 102(e) Date: Oct. 25, 1999

(87) PCT Pub. No.: WO99/31338

PCT Pub. Date: Jun. 24, 1999

(30) Foreign Application Priority Data

Dec. 15, 1997 (DE) ..... 297 22 000 U

(51) Int. Cl.[7] ..... E05B 13/10

(52) U.S. Cl. ..... 70/208; 70/215; 292/202; 292/336.3

(58) Field of Search ..... 70/208–212, 215; 292/200, 202, 336.3, DIG. 31

(56) References Cited

U.S. PATENT DOCUMENTS

| | | | | |
|---|---|---|---|---|
| 4,134,281 | | 1/1979 | Pelcin . | |
| 5,454,239 | * | 10/1995 | Esaki et al. | 70/208 |
| 5,457,971 | * | 10/1995 | Yamada | 70/208 |
| 5,467,623 | * | 11/1995 | Yamada et al. | 70/208 |
| 5,469,725 | * | 11/1995 | Yamada | 70/208 |
| 5,566,992 | | 10/1996 | Anderson et al. . | |
| 5,873,274 | * | 2/1999 | Sauerland | 70/208 |
| 6,039,363 | * | 3/2000 | Sugimura et al. | 70/208 X |

FOREIGN PATENT DOCUMENTS

| | | |
|---|---|---|
| 24 34 998 | 2/1976 | (DE) . |
| 91 13 481 | 12/1991 | (DE) . |
| 0 054 225 | 6/1992 | (EP) . |
| 641919 | 8/1928 | (FR) . |
| 2 743 105 | 7/1997 | (FR) . |
| 2 276 910 | 10/1994 | (GB) . |

* cited by examiner

*Primary Examiner*—Suzanne Dino Barrett
(74) *Attorney, Agent, or Firm*—Reed Smith LLP

(57) ABSTRACT

A pivoting lever closure is disclosed for the door, the sidewall or the like of an electrical control cabinet, a machine casing or the like, comprising an actuation shaft traversing the door leaf or the like, locking devices driven by the actuating shaft such as a sash lock and/or a bar lock, a cavity that can be placed on the door leaf or the like, an actuating lever which can be pivotally actuated on the actuating shaft around an axis which is perpendicular to the axis of the actuating shaft and which can be blocked in a pivoting position in the cavity by a locking device (i.e. a padlock) and can be swung out of the cavity. The actuating shaft can be rotated by the actuating lever from the cavity in the pivoting position.

9 Claims, 4 Drawing Sheets

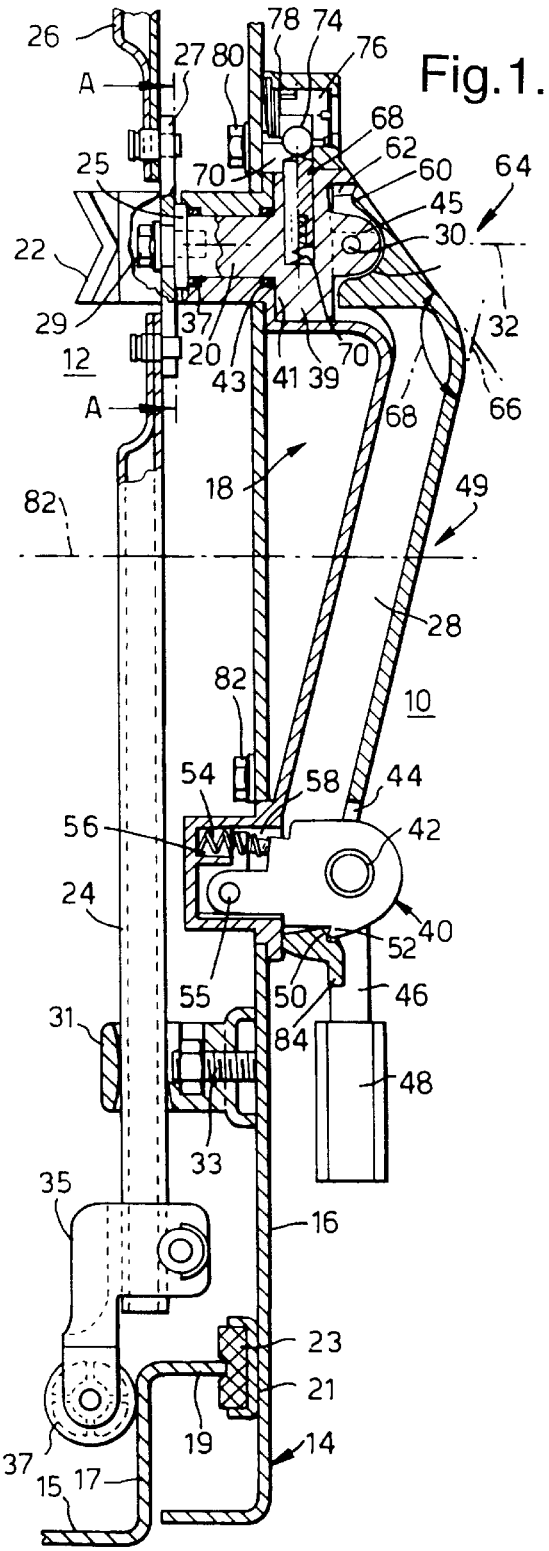
Fig.1.
Fig.2.
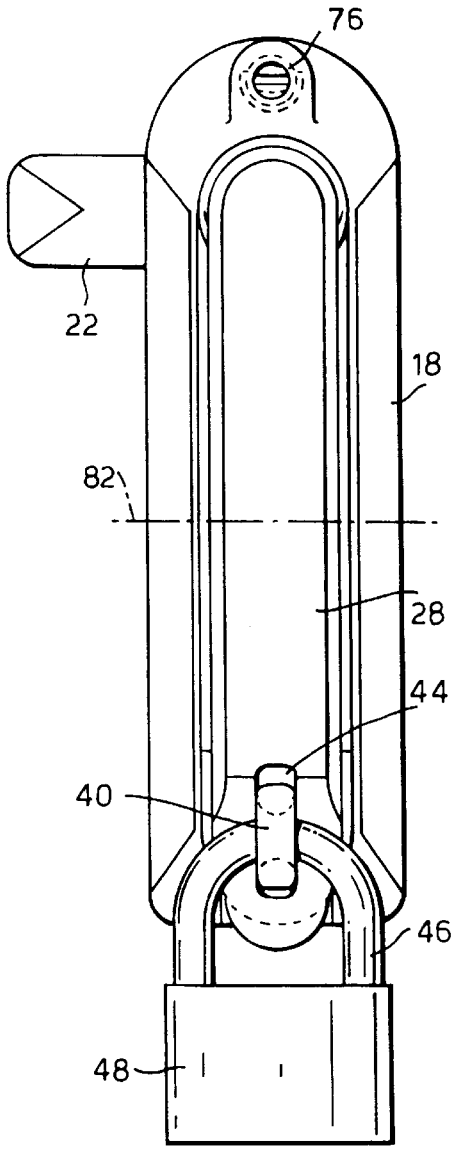
Fig.3.
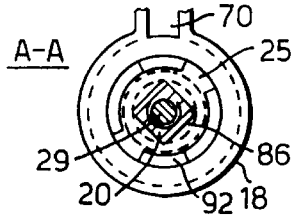

PIVOTING LEVER CLOSURE FOR DOOR OR SIDEWALL OF AN ELECTRICAL CONTROL CABINET OR A MACHINE CASING

BACKGROUND OF THE INVENTION a) Field of the Invention

The invention relates to a swivel lever closure for the door, side wall, or the like, of a switch cabinet, machine enclosure or the like, with an actuating shaft which extends through the door leaf, with locking devices, such as a sash lock and/or bar lock, which are drivable by the actuating shaft, with a dish or cavity that can be placed on the door leaf or the like, with an actuating lever which is articulated at the actuating shaft so as to be swivelable about an axis extending vertical to the axis of the actuating shaft and which can be secured in a swiveled in position in the cavity by means of a locking device and can be swiveled out of the cavity, wherein the actuating shaft can be rotated by means of the actuating lever into the position which is swiveled out from the cavity.

b) Description of the Related Art

A swivel lever closure of the type mentioned above is known, for example, from page 2–105 of a catalog from DIRAK GmbH und Co. KG, Kaiserstr. 55–59, 58332 Schwelm. Further, reference is had to EP 0 054 225 B1 and U.S. Pat. No. 5,450,735.

All of the cited references show swivel lever shapes which extend in a straight line parallel to the surface of the door or the like when swiveled in. Therefore, when the lever is swiveled out, it extends at a sharply acute angle to this surface of the door leaf or the like, which is inconvenient on the one hand and, on the other hand, reduces the effective lever arm length by which the lever projects in the swiveled out state on the door leaf surface and accordingly increases the forces required for rotation. In this respect, a swivel lever closure described in DE 297 05 778 U1 has a slight inclination, but its cavity has a very long constructional length in comparison to the length of the fastening lever.

Further, with the exception of the first swivel lever from the catalog cited above, none of the swivel lever closures provides the possibility of locking with a padlock.

In contrast to the prior art, it is the object of the invention to shape the swivel lever closure in such a way that the cavity has only a slightly larger constructional length than the actuating lever and such that the swivel lever closure can be conveniently handled in the swung out state and nevertheless offers the possibility of locking with a padlock, wherein provisional locking should also be possible without a padlock.

This object is met first in that the actuating lever has a first shorter portion which proceeds from the axis of articulation at the actuating shaft and which is directed at an inclination away from the plane of the door leaf or the like when the lever is swiveled into the cavity, and a second, longer portion following the first portion which is directed at an inclination toward the plane of the door leaf when the swivel lever is positioned so as to be swiveled into the cavity.

As a result of these features, it is possible for the user when swiveling out the handle to move this handle into a position such that a substantial portion of the swivel lever extends either parallel to or at a smaller angle to the door leaf plane, which facilitates handling.

This lever shape is also advantageous in that particularly favorable relationships result when, according to another feature, the cavity has, in its area receiving the free end of the lever, a shoulder such as an eyelet which projects through a notch or slit of the lever end when the lever is in its swiveled in position. That is, in a surprisingly advantageous manner, the inclined shape creates space for this eyelet without increasing the constructional height.

In this connection, it is noted that the swivel lever actuation according to page 2–105 of the catalog from DIRAK GmbH & Co. KG also has an eyelet whose purpose, according to this reference, is to secure the swivel lever by means of a padlock. A disadvantage in this known arrangement is that the shoulder projects far over the surface of the swiveled in swivel lever and accordingly not only increases the constructional height, but also presents an obstacle to persons passing by it. Due to the fact that the shoulder in the center of the cavity projects out very far, this shoulder also impedes the user's hand when the lever is swiveled out. In contrast to this known arrangement, the shoulder or eyelet according to the invention through which the padlock can be inserted presents less of an obstacle. This is achieved primarily in that the cavity carries the shoulder, such as an eyelet, in its area receiving the free end of the lever rather than in the center, wherein the shoulder projects through the notch or slot of the lever end when the lever is in the swiveled in position. Due to the special shape of the lever, in which the area of the junction between the two inclined areas is the area located farthest away from the door leaf surface, the eyelet does not project out as far as the farthest projecting area of the swivel lever and therefore no longer presents an obstacle. In addition to this, the eyelet is located below the projecting area of the lever when the latter is arranged vertically, as is usually the case, and also presents less of an obstacle.

As a result of the arrangement of the eyelet, it is possible for the shoulder or the eyelet to be mounted so as to be swivelable against spring force and to form a protuberance or offset which secures the swivel lever in the swiveled in state. A disadvantage of the known arrangement, wherein the swivel lever is prevented from swiveling out only when a padlock is actually inserted, is avoided by means of this feature. However, there are also cases in which a padlock of this type will not be provided at least at certain times, in which case the known arrangement is not protected against an unintentional swiveling out of the swivel lever. This swiveling out can occur when, as a result of shaking movement such as can occur during earthquakes or during operation of a vibrating machine, the swivel lever exits from its cavity, in which case there is a risk that it will rotate with the driving shaft to the extent that the locking device opens and, e.g., the door leaf of the switching cabinet secured by the closure will stand open. Switching cabinets which are located, e.g., on crane installations where there are often a plurality of, e.g., as many as 30, switching installations which are enclosed by a switch room are subject to especially strong shaking movements. It is unacceptable for switch cabinet doors of this type to be able to open unintentionally due to shaking movements, even if they do not all have padlocks.

EP 0 054 225 B1, U.S. Pat. No. 5,450,735, and DE 297 05 778 U1, but also the arrangement known from the catalog (see the note on the possibility of combination with a profile cylinder), offer the possibility of providing a profile cylinder which can likewise secure the actuating lever irrespective of a padlock. However, combining a swivel lever closure with a padlock as well as a profile cylinder complicates the arrangement because two keys are then necessary, a first key for the padlock and a second key for the profile cylinder.

OBJECT AND SUMMARY OF THE INVENTION

Obviously, it is not possible in the known arrangements according to the above-cited references to simply press in and lock the actuating lever. When a key-actuated arrangement is provided, it must—at least in the European and U.S. patents—first be locked by means of a key, e.g., as in the case of a cylinder lock, or a padlock must be inserted in order to lock as in the catalog reference.

Therefore, the invention also has the primary object of further developing the known arrangement in such a way that the actuating lever can be pressed into its locked position and securely held in this position also without the use of a padlock and without using a cylinder which is actuated by key.

Further, it should be possible to move the actuating lever out of this pressed in secured position without special tools.

These additional objectives are met in that the above-mentioned shoulder or eyelet is mounted so as to be swivelable against spring force and a protuberance or offset is formed by the eyelet which secures the swivel lever in the swiveled in state. In this connection, it is advantageous that the eyelet performs two functions simultaneously, namely, it provides a bore hole for receiving the shackle of a padlock which, when inserted, prevents the lever from swiveling out and also provides a protuberance or offset which brings about a locking by means of simply pressing in when the padlock is not used.

It is particularly advantageous in this respect when the spring loading of this protuberance or eyelet is carried out in such a way that it acts in the same direction as the weight of an inserted padlock.

Further, it should be possible to release the actuating lever from this pressed in, locked position without needing special tools. This is achieved in that the eyelet head can be moved out of its locking position against the spring force simply by exerting a pressing force with the thumb.

It may be advantageous when the actuating lever also has an additional lock which can be actuated by means of a tool. This provides a security which, while inferior in degree to the security afforded by a padlock, makes it possible to lock when there is no padlock present in such a way that the locking cannot be canceled without a tool. In order to meet this object, a locking device can be provided in the area of the driving shaft, which locking device can only be actuated by a tool such as a wrench, screwdriver, or the like and which prevents rotation of the actuating shaft by the swivel lever.

There are various possible embodiment forms for this additional locking device which will be described more fully in the following.

With respect to design, it is advantageous when the cavity has two projections, preferably with the same dimensions, which project through the door leaf or the like, wherein one projection forms a locking shaft bearing and the other projection is formed by the fastening for the shoulder or eyelet. On the one hand, this secures the cavity against rotation on the door leaf; on the other hand, fastening can be carried out by means of parts which are present in any case and accordingly certain elements of the closure can serve a dual purpose.

It is advantageous when the fastening is carried out in such a way that the closure is constructed such that it can be used in a right-handed manner as well as in a left-handed manner, i.e., such that its actuation projections advantageously require through-openings in the door leaf which are identical and symmetric to the center of the door and the connection between the lever arm and driving shaft can be switched in such a way that turning to the right and turning to the left can both lead to a desired function.

The projections can form circumferential threads on which fastening screw nuts can be screwed, so that the door leaf is clamped between the latter and the cavity. This results in a particularly simple assembly of the arrangement.

The actuation used for the swivel lever closure according to the invention is suitable for actuating a sash lock or also a flat bar lock or a round bar lock.

BRIEF DESCRIPTION OF THE DRAWINGS

The invention will be described more fully in the following with reference to embodiment examples shown in the drawings.

FIG. 1 shows a side view of a swivel lever closure, constructed according to the invention, for a door of a switch cabinet, wherein locking can be carried out by a padlock, additional locking is provided by means of an eyelet offset, and additional locking is provided in the area of the lock shaft;

FIG. 2 is a top view of the arrangement according to FIG. 1;

FIG. 3 is a sectional view along line A—A in FIG. 1;

DESCRIPTION OF THE PREFERRED EMBODIMENTS

Figure 4:
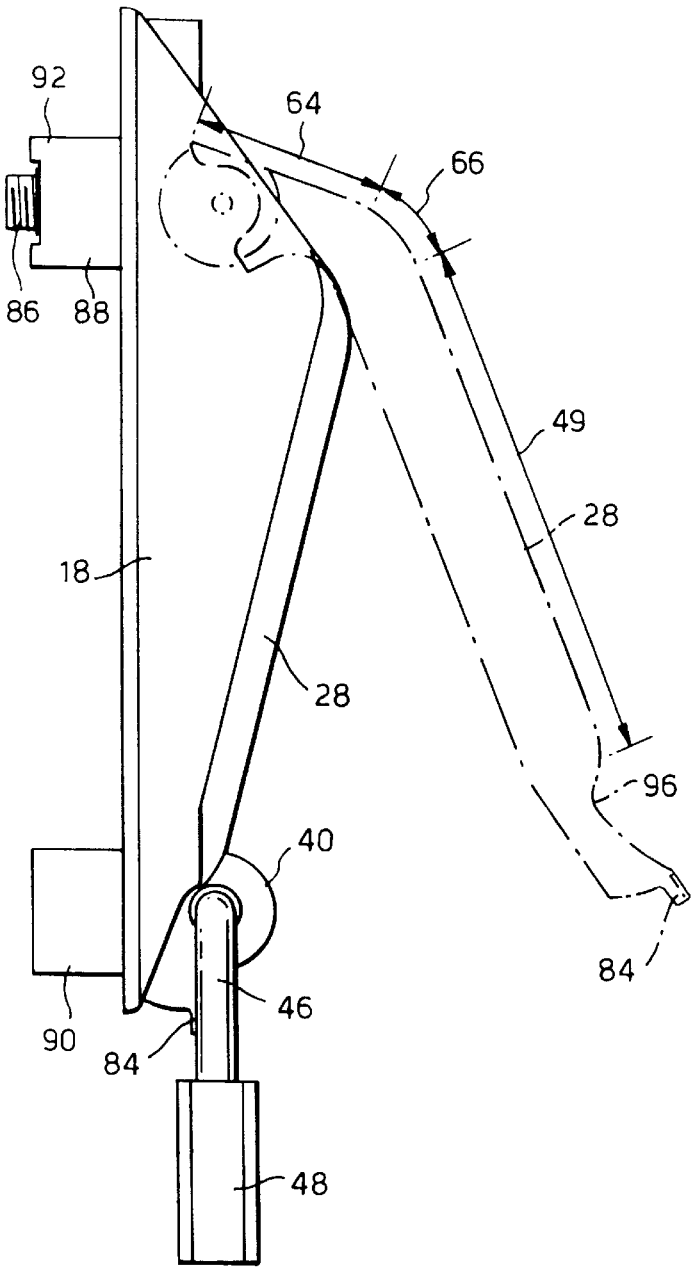
FIG. 4 shows a side view of the actuation device (cavity with handle) for the swivel lever closure.
Figure 5:
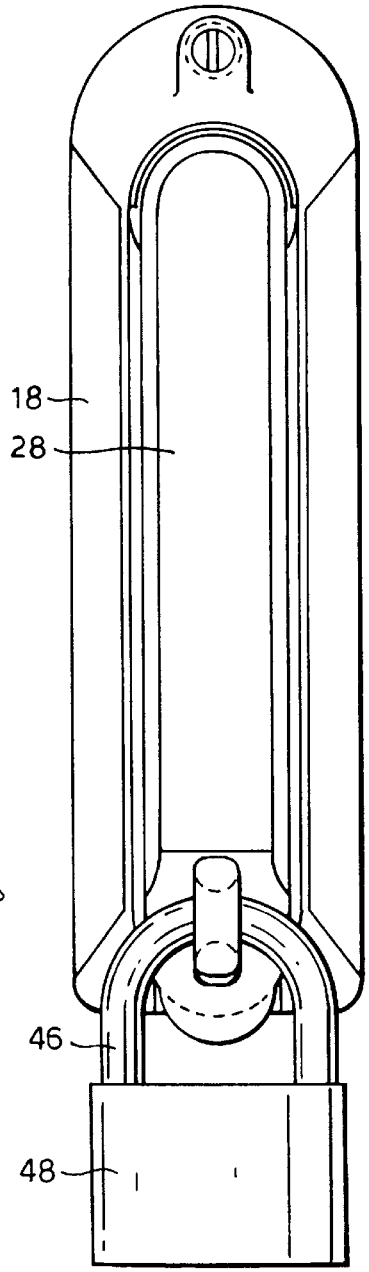
FIG. 5 is a top view of the arrangement according to FIG. 4.

FIG. 1 shows a side view of a closure 12 for a switch cabinet 14 or machine housing wall or the like, wherein the closure 12 comprises a swivel lever actuation 10 with a cavity 18 which is arranged on the outer surface 16 of the switch cabinet door 14 or the like. A locking shaft or actuating shaft 20 which in this case drives a sash 22 and locking bars 24, 26 extending along the door leaf 14 is arranged in the cavity 18. The bars 24, 26 are articulated at a disk 27 which also carries or forms the sash'tongue 22 and which is fastened to the actuating shaft 20 by means of a screw 29. When the actuating shaft 20 is rotated, the disk 27 and, with it, the sash 22, are also rotated; moreover, the locking bars 24, 26 articulated at the disk 27 are displaced upward or downward. According to FIG. 1, the locking bar 24 is mounted in a bar guide 31 which may be made of plastic and may be held by a Stub bolt 33 which is spot-welded to the door leaf 14. A holder 35 which carries a run-up roller 37 is arranged and clamped on the lower end of the bar 24. When the bar 24 is displaced downward,-the roller 37 runs up on an angled surface 17 formed by the cabinet frame 15 and in so doing presses the door leaf 14 via the bar guide 31 against the frame angle 19, wherein the inner surface of the door leaf 14 carries a U-shaped holding web 21 for a sealing strip 23 against which the front edge of the angle 19 presses in a sealing manner. The locking bar 24 can be constructed as a flat strip or as a solid round bar or, as is shown here, as a tubular arrangement that is pressed flat at its articulated end.

The actuating shaft 20 is rotatably mounted inside a corresponding bearing bore hole of the cavity 18 and is axially fixed at its end facing the sash 22 by a disk 25 that is held by disk 27 and by the associated screw 29, wherein an O-ring seal 37 is also advisably provided. For torsion bar support of the disk 27, the shaft 20 advisably forms a polygon, such as a rectangle, on which a corresponding polygonal opening or rectangular opening of the disk 25 or 27 is mounted so as to be rigid with respect to rotation. At its opposite end, the actuating shaft 20 has a head 39 which, in itself, contacts the shoulder 41 of the bearing area of the cavity 18, possibly so as to be sealed by means of an O-ring seat 43. The head 39 carries at its outer end a half-cylinder projection 45 on which a handle or actuating lever 28 is articulated about an axis 30 extending transverse to the shaft axis 32 of the shaft 20, wherein the half-cylinder projection 45 is received so as to fit in a corresponding recess 47 of the lever in such a way that the lever 28 can be swiveled out of the position in which it is inserted into the cavity 18 to the extent that it is freely rotatable about the axis 32 together with the shaft 20.

The actuating lever 28 shown in FIG. 1 is enclosed on the sides in the swiveled in position by edges formed by the cavity 18, so that the actuating lever is prevented by this enclosure from being rotated out of its position oriented to the cavity. Therefore, it is not possible to open the door in this position of the lever 28. When the actuating lever 28 is directed vertically downward in its locking position, its own gravitational force or friction can suffice in itself to keep it in this position. However, during shaking movements such as those which can occur, for example, in crane installations, there is a risk that the actuating lever 28 will move out of its swiveled in position and be released from the cavity 18 and that, as a result of further shaking movement, a rotation will be carried out about axis 32, so that the closure 12 opens in certain cases and therefore exposes the interior of the switch cabinet in an unwanted manner. It is also possible that an unauthorized person will swivel out the actuating lever 28 and move the closure out of its closed position into an open position by rotating about the axis 32 and will accordingly be able to open the door 14 of the switch cabinet 15.

In order to prevent this, the cavity 18 can have a shoulder 40, wherein an eyelet 42 is arranged at the free end of the shoulder 40 in such a way that, when the actuating lever 28 is swiveled into the cavity 18, this eyelet 42 projects through an opening 44 in the actuating lever 28 and the shackle 46 of a padlock 48 can be inserted through the eyelet 42, so that the actuating lever 28 is prevented from being swiveled out.

As is clear from FIG. 1, the actuating lever 28 is outfitted in the area of the opening 44 for the shoulder 40 with an edge 50 which can be engaged by an offset formed by the eyelet 40, wherein this engagement is brought about on the one hand by the weight of an inserted padlock 48, but, on the other hand, also by a pressure spring 54 which presses the shoulder 40 in the clockwise direction, this shoulder 40 being supported in the cavity 18 so as to be rotatable about an axis 55. The pressure spring 54 is constructed as a spiral spring which, on the one hand, is received in a pocket 56 formed by the cavity and, on the other hand, is held at the other end by a projection 58 proceeding from the shoulder 40. Therefore, in the rest position or inactive position, the eyelet 40 secures the hand lever 28 in the swiveled in position by its offset protuberance 52. However, when the padlock 48 is removed from the eyelet 42, the shoulder 40 can be pressed upward with the eyelet 42 in the counter-clockwise direction about the axis 55 against the force of the spring 54 by the user's thumb, so that the surface 52 releases surface 50 and allows the hand lever 28 to be swiveled outward out of the position shown in the drawing until it is prevented from a further swiveling movement about the axis 30 in that the lever surface 60 strikes against the head surface 62. The geometric relationships are advisably selected in such a way that the swivel limiting action takes effect when the hand lever 28 whose area 49 extends at an inclination to the plane of the door leaf 16 in the swiveled in position, as can be seen from FIG. 1, is then oriented, with respect to this surface 49, substantially parallel and at a distance to the door plane 16 or is swiveled out somewhat farther, as is shown, e.g., in FIG. 4. This is a position in which the hand lever 28 is disengaged from the edges of the cavity 18 on the one hand and from the shoulder 40 on the other hand and it is therefore possible for the hand lever 28 to rotate about axis 32.

For this purpose, the actuating lever 28 has a first portion 64 proceeding from the articulation axis 30 at the actuating shaft 20, which first portion 64 (as is shown) is directed at an inclination away from the plane of the door leaf 16 when the lever 28 is swiveled into the cavity 18 and which causes the distance of the lever from the door leaf when this lever is swiveled out, followed by a second portion 48 which is directed at an inclination toward the plane of the door leaf 16 in the position of the swivel lever 28 in which the swivel lever 28 is swiveled into the cavity; this second portion 49 forms the handle area. Accordingly, as viewed from the side, the two portions 64, 49 form a roof which is set on the plane of the door leaf 16 with a roof ridge area 66 that projects over all other parts of the closure actuating arrangement, including the shoulder 40. The ridge area is advisably rounded so as to interfere as little as possible with persons passing by it.

When the lever is swiveled out, the lever area 49 achieves, e.g., an approximately parallel position with respect to the door leaf 16.

At the same time, the lever area 64 achieves an almost perpendicular position, for example. This arrangement of the swivel lever facilitates the rotating movement. The construction according to the invention provides space below the lever allowing the uses hand a firm grip without this position of the lever being excessively inclined to the door leaf.

The transitional area between the two portions 64 and 49, that is, the roof ridge 66, forms a (rounded) angle which may range between 90° and 150°. In the embodiment form shown in the drawing, this ridge angle 68 is approximately 125°.

The great advantage in securing by means of a padlock 48, as is shown in FIG. 1, consists in that an individual padlock 58 belonging to a certain person can be used, for example, at certain times and for certain reasons, so that it is possible for this person to secure a door against unauthorized opening. Only this person can open the padlock again by means of the appropriate key, remove the padlock, and then open the respective door closure 12 by swinging out and then turning the actuating lever 28. When a special locking of this kind is not required at certain times, a padlock can also be advantageously omitted. In order for the actuating lever to be secured in the swiveled in position nevertheless in this case, there is provided the above-described hook device which is formed by the surface 52 of the shoulder 40 and the surface 50 of the cavity 18 and which snaps into the end position so as to lock when the actuating lever is swiveled in. Therefore, the lever can be locked without the need to insert a lock simply by swiveling in such that an unintentional opening, e.g., due to shaking movements, cannot take place. On the other hand, the locking can be canceled again without great effort in that the shoulder 40 is displaced upward with the thumb in order to be able to move the lever 28 out of its swiveled in position again.

The actuating lever 28 can be provided in the area of its articulation axis 30 with another spring device, not shown, so that it can also be moved out of its swiveled in position automatically when needed. When the shoulder 40 is pressed with the thumb in this case, the hook formed by the surface 50 is freed and the spring action presses the actuating lever 28 out of its swiveled in position provided it is not impeded by an inserted padlock 48.

As is shown in FIG. 1, another (third) locking possibility can also be provided, wherein a spring-loaded pin 68 is arranged in the head 39 of the shaft 20. In the position shown in the drawing, this pin projects into a slot 70 formed by the shaft bearing bore hole of the cavity 18. The pin secures the shaft 20 against rotation in the position shown. In order to enable rotation out of the shown position, the pin 68 must be pressed back against the force of the spring 72 until it is entirely pulled back out of the slot 70. This is achieved, for example, by means of a ball 74 which can be forced in the direction of the pin by a slotted screw 76. This slotted screw 76 can be actuated, e.g., against the force of a spring 78, by means of a tool such as a screwdriver and the screw is automatically forced back into its initial position, e.g., after the tool is removed. This means that in order to swivel the lever out of its shown position into an open position for the door closure, a tool such as a screwdriver must turn the slotted head screw 76 out of the shown position until the ball 74 has forced the pin 68 back against the force of the spring 70, whereupon the hand lever 23 can be swiveled. When the tool is removed from the slotted head screw 76, the latter returns to its initial position due to the spring force 78 and, when the lever is swiveled back into its shown position, allows the pin 68 to slide back into its locking position and accordingly lock the hand lever 28.

According to FIG. 4, the cavity 18 has a projection 38 which projects through the door leaf, where it is part of a lock shaft bearing and, e.g., supports the shaft 20 with a rectangle 86 which proceeds therefrom and supports the disk 27 so as to be fixed with respect to rotation relative to it. A second projection 90 is provided at the lower end of the cavity 18 and contains, for example, the swivelable eyelet 40 which was described in connection with FIG. 1.

Both shoulders have the same outer diameter, for example, and have, e.g., an external thread so that a union nut can be screwed on. When the door leaf has corresponding openings that can receive the projections 88, 90, the cavity can be arranged on the door leaf and secured by means of the two union nuts.

Alternatively, however, the fastening can also be carried out by means of special head screws 80, 82 which are guided through appropriate bore holes in the door leaf 16 and can be screwed into corresponding threaded bore holes inside the cavity 18, not shown.

The openings are advisably arranged in the door leaf 16 in such a way that they are symmetric with respect to an axis 82 representing the center dividing line of the door leaf. In this case, the closure can be installed so as to be rotated by 180° so that a door can be converted from left-hand to right-hand. In this case, the door is rotated by 18°.

In order to be able to adapt the actuating direction of the swivel lever 28, for example, to open in the rotating direction away from the edge of the door, a coupling element 25 is advisably provided according to FIG. 3, wherein the coupling element 25 is arranged on the rectangle 86 and can move between projections 92 (FIG. 4) formed by the cavity 18. The movement path between stops formed by the projections 92 is, e.g., exactly 90°.

FIG. 4 shows that the end of the lever 28 has the shape of a nose-shaped projection 84 which is concealed and protected by the shackle of the padlock 48 when a padlock 48 is inserted. When the padlock 48 is removed, the projection 84 can be grasped by a finger after the eyelet 40 is displaced upward and the swivel lever 28 can be swiveled downward as is shown in dashed lines in FIG. 4. The extent to which the lever can be swiveled out depends on the corresponding play or clearance formed between surface 45 and surface 62 according to FIG. 1 and can be selected as needed. In order to create additional space for the shackle 46, the end of the lever 28 also has a depression or indentation 96.

Figure 6:
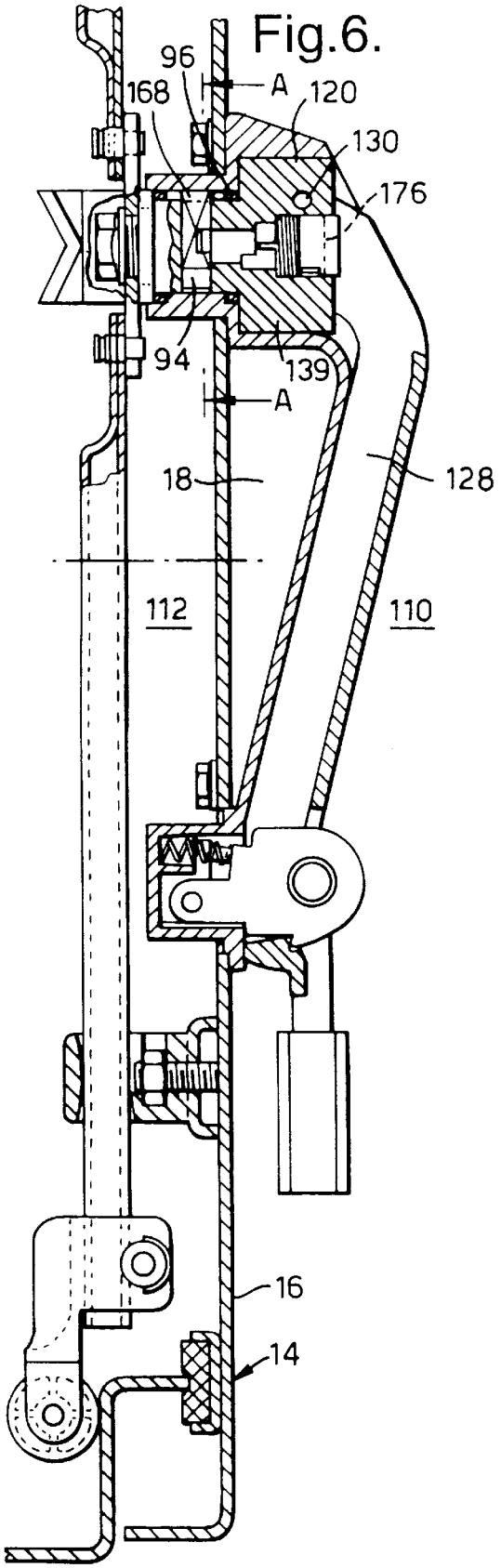
FIG. 6 is a view similar to FIG. 1, in which the locking in the area of the driving shaft is modified.
Figure 7:
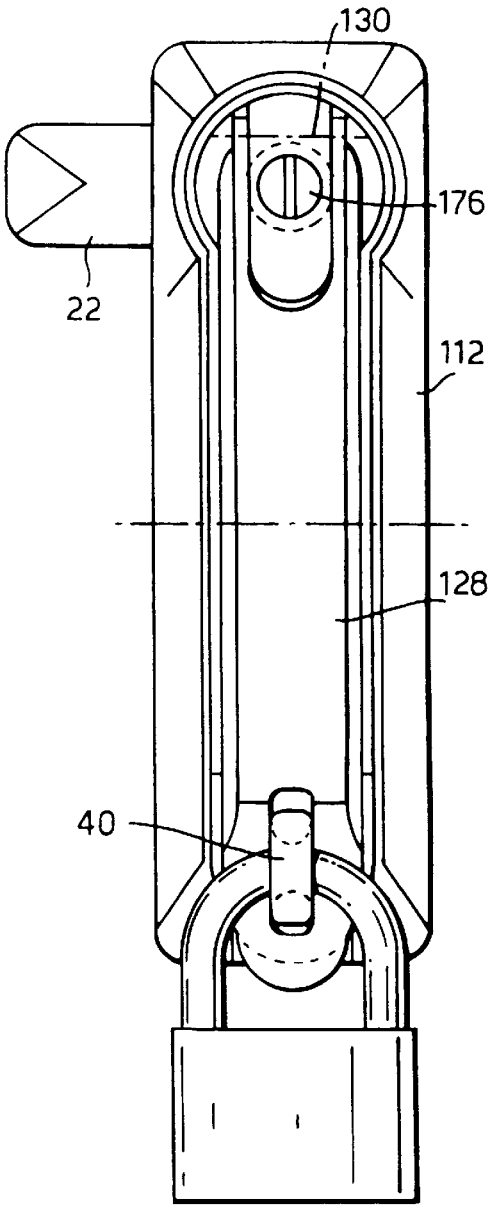
FIG. 7 is a top view of the arrangement according to FIG. 6.
Figure 8:
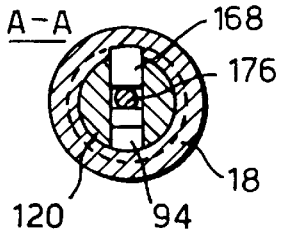
FIG. 8 is a sectional view along line A—A of FIG. 6 for describing the locking in the area oft lock shaft.

FIG. 6 shows an embodiment form in which the head 139 of the actuating shaft 120 has a somewhat different construction than that shown in FIG. 1. A locking pin 168 is displaced by means of an eccentric screw 176 inside a bore hole 94 in such a way that the pin 168 is either pulled back in the shaft area until it does not project into a slot 96 arranged axially in the shaft bore hole for the shaft 120. Depending on the position of the screw 176, the shaft 120 can accordingly be rotated in the cavity bore hole or not.

The advantage of the additional locking in the area of the actuating shaft 20, 120 is that the closure is locked even before the lever has reached the fully swiveled in position, that is, when it has not yet reached its end position. An arrangement of this kind is particularly important for the U.S. market, where this type of lock is known as a "defeater." In the known devices, for example, in U.S. Pat. No. 5,450,735, it is not possible to lock the closure until the lever is in its end position inside the cavity. This is disadvantageous in that it allows the closure to open in an unwanted manner in case of a rotational movement in the event that the user forgets to swivel in the lever. Therefore, the arrangement according to the invention offers greater security.

Figure 9:
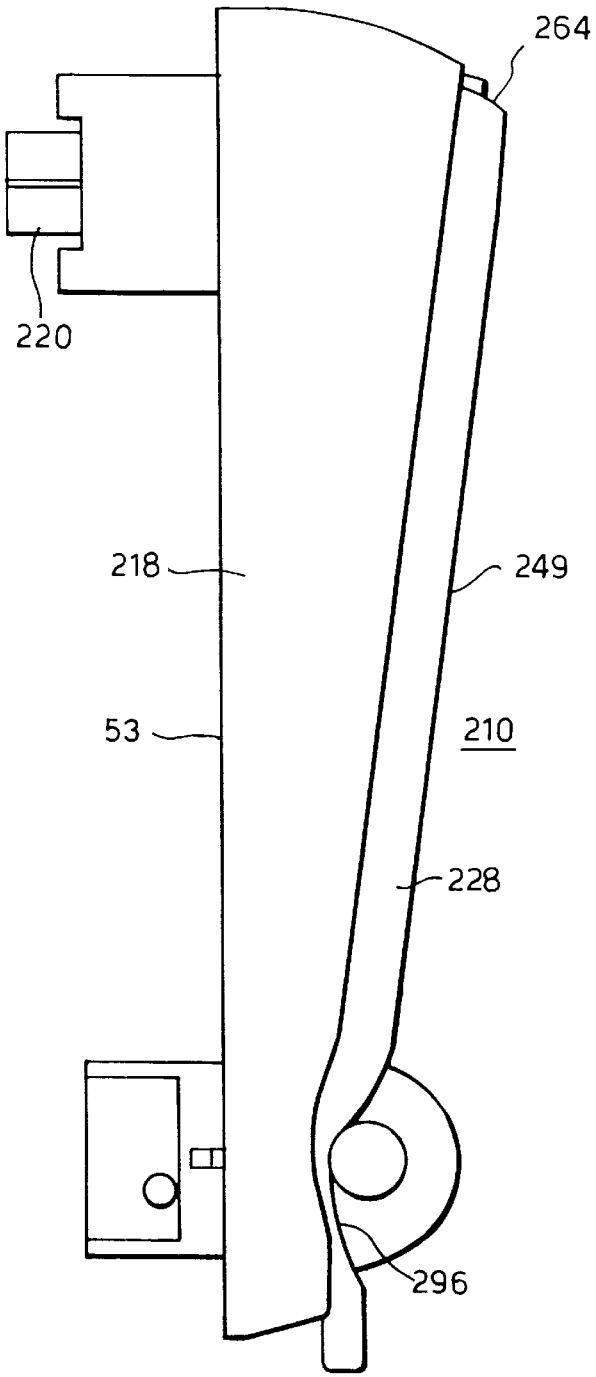
FIGS. 9 and 10 show two additional embodiment forms of a swivel lever closure according to the invention in a side view.

FIG. 9 shows a swivel lever arrangement 210 similar to that shown in FIG. 4, wherein the inclination of the second portion 249 of the hand lever 228 in its swiveled in position is reduced with respect to the fastening surface 53 of the cavity 218, which results in a somewhat smaller constructional height. Further, the cavity 218 encloses the actuating lever 228 completely at its end provided with the countersink 296. Moreover, the first portion 264 located in the area of the actuating shaft 220 is oriented at a steeper inclination relative to the run-up surface 53.

Figure 10:
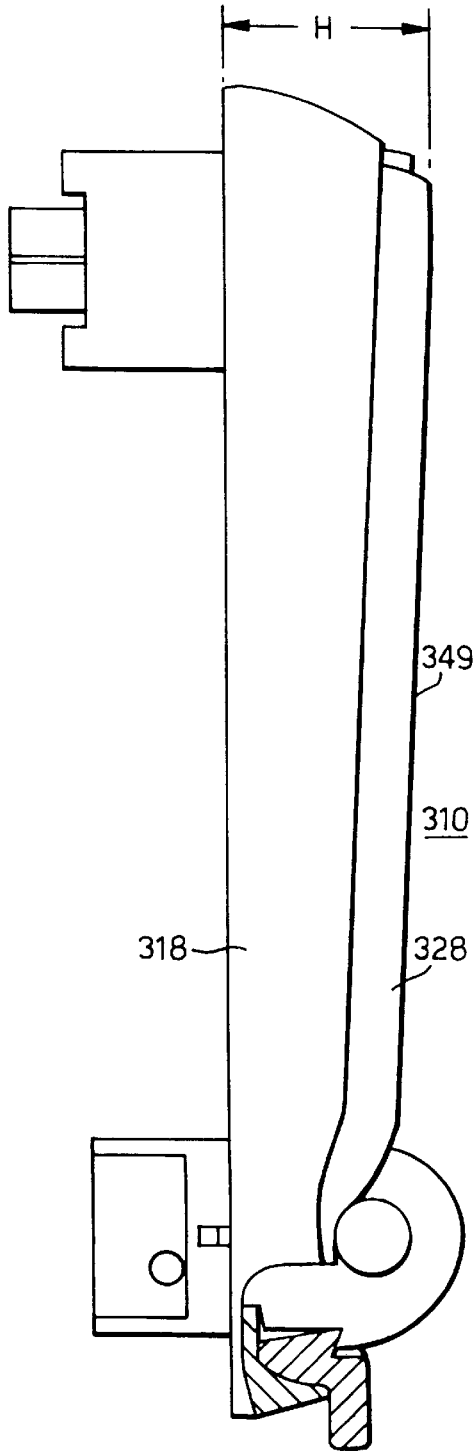

FIG. 10 shows a swivel lever arrangement 310 with an even flatter second portion 349, so that the overall height H is further reduced. It can also be seen that the free end of the actuating lever 328 is more securely enclosed by the cavity 318, which offers greater protection for the actuating lever against unauthorized tampering than is the case, e.g., in the embodiment form shown in FIG. 1.

COMMERCIAL APPLICABILITY OF THE INVENTION

While the foregoing description and drawings represent the present invention, it will be obvious to those skilled in the art that various changes may be made therein without departing from the true spirit and scope of the present invention.

What is claimed is:

1. A swivel lever closure for the door or side wall of a switch cabinet or machine enclosure comprising:

an actuating shaft which extends through a door leaf;

locking devices, including a sash lock and/or bar lock, which are drivable by said actuating shaft;

said door leaf having a cavity placed thereon;

an actuating lever which is articulated at said actuating shaft so as to be swivelable about an axis extending vertical to the axis of the actuating shaft and which can be secured in the swiveled in position in the cavity by a locking device or can be swiveled out of the cavity;

said actuating shaft able to be rotated by said actuating lever into a position in which said actuating lever is swiveled out from the cavity;

said actuating lever having a first portion which proceeds from the axis of articulation at the actuating shaft and which is directed at an inclination away from the plane of the door leaf when the actuating lever is swiveled into the cavity; and a second portion following the first portion which is directed at an inclination toward the plane of the door leaf when the actuating lever is positioned so as to be swiveled into the cavity wherein said first portion is substantially shorter than said second portion.

2. A swivel lever closure for the door or side wall of a switch cabinet or machine closure comprising:

an actuating shaft which extends through a door leaf;

locking devices, including a sash lock and/or bar lock, which are drivable by said actuating shaft;

said door leaf having a cavity placed thereon;

an actuating lever which is articulated at said actuating shaft so as to be swivelable about an axis extending vertical to the axis of the actuating shaft and which can be secured in the swiveled in position in the cavity by a locking device or can be swiveled out of the cavity;

said actuating shaft able to be rotated by said actuating lever into a position in which said actuating lever is swiveled out from the cavity;

said cavity having, in an area receiving the free end of the lever, a shoulder such as an eyelet which projects through a notch or slit of the lever end when the actuating lever is in a swiveled in position; and said shoulder or the eyelet being mounted so as to be swivelable against spring force and forming a protuberance or offset which secures the actuating lever in the swiveled in state.

3. A swivel lever closure for the door or side wall, of a switch cabinet or machine closure or the like comprising:

an actuating shaft which extends through a door leaf;

locking devices, including a sash lock and/or bar lock, which are drivable by said actuating shaft;

said door leaf having a cavity placed thereon;

an actuating lever which is articulated at said actuating shaft so as to be swivelable about an axis extending vertical to the axis of the actuating shaft and which can be secured in the swiveled in position in the cavity by a locking device or can be swiveled out of the cavity;

said actuating shaft able to be rotated by said actuating lever into a position in which said actuating lever is swiveled out from the cavity;

said actuating lever having a first portion which proceeds from the axis of articulation at the actuating shaft and which is directed at an inclination away from the plane of the door leaf when the actuating lever is swiveled into the cavity; and a second portion following the first portion which is directed at an inclination toward the plane of the door leaf when the actuating lever is positioned so as to be swiveled into the cavity; and said cavity having, in an area receiving the free end of the lever, a shoulder such as an eyelet which projects through a notch or slit of the lever end when the lever is in its swiveled in position; and said shoulder or the eyelet being mounted so as to be swivelable against spring force and forming a protuberance or offset which secures the actuating lever in the swiveled in state.

4. The swivel lever closure according to claim 2 or claim 3, wherein the eyelet has a bore hole for receiving the shackle of a padlock which, when inserted, prevents the actuating lever from swiveling out.

5. The swivel lever closure according to claim 1 or claim 2 or claim 3, wherein the actuating lever has an indentation in the area of the shackle for the padlock, wherein the indentation receives the shackle so that the shackle fits therein.

6. The swivel lever closure according to claim 1 or claim 2 or claim 3, wherein the actuating lever can be swiveled in against spring force.

7. The swivel lever closure according to claim 1 or claim 2 or claim 3, wherein the cavity forms projections which extend through the door leaf and which have circumferential threads on which fastening screw nuts can be screwed, so that the door leaf is clamped between the fastening screw nuts and the cavity.

8. The swivel lever closure according to claim 1 claim or claim 2 or claim 3, wherein the cavity has threaded bore holes in which fastening nuts can be screwed, which fastening nuts extend through corresponding bore holes in the door leaf.

9. The swivel lever closure according to claim 1, or claim 2 or claim 3, wherein a locking device is provided in the area of the driving shaft, which locking device can only be actuated by a tool and which prevents rotation of the actuating shaft by the swivel lever.

* * * * *